US008196350B2

(12) United States Patent
Arimoto et al.

(10) Patent No.: US 8,196,350 B2
(45) Date of Patent: Jun. 12, 2012

(54) BOTTOM DRIVE RAIL-LESS WINDOW REGULATOR

(75) Inventors: Shigeki Arimoto, Bloomfield, MI (US); Takuma Ishida, Rochester Hills, MI (US)

(73) Assignee: Hi-Lex Controls, Inc., Rochester Hills, MI (US)

( * ) Notice: Subject to any disclaimer, the term of this patent is extended or adjusted under 35 U.S.C. 154(b) by 392 days.

(21) Appl. No.: 12/399,105

(22) Filed: Mar. 6, 2009

(65) Prior Publication Data

US 2010/0223852 A1 Sep. 9, 2010

(51) Int. Cl.
*E05F 11/48* (2006.01)

(52) U.S. Cl. ..... 49/352; 49/348; 49/374

(58) Field of Classification Search ..... 49/348, 49/349, 374, 502; 74/502.4, 502.6, 500.5, 74/501.5 R, 501.6

See application file for complete search history.

(56) References Cited

U.S. PATENT DOCUMENTS

| | | | | | |
|---|---|---|---|---|---|
| 4,442,632 | A * | 4/1984 | Greco et al. | ..... | 49/352 |
| 4,449,326 | A * | 5/1984 | Hori et al. | ..... | 49/375 |
| 4,637,166 | A * | 1/1987 | Ujihara | ..... | 49/352 |
| 5,528,861 | A * | 6/1996 | Beyerlein | ..... | 49/352 |
| 6,233,873 | B1 * | 5/2001 | Lawrie et al. | ..... | 49/375 |
| 2002/0166288 | A1 * | 11/2002 | LeGallo | ..... | 49/352 |
| 2003/0066244 | A1 * | 4/2003 | Staser et al. | ..... | 49/375 |
| 2004/0065018 | A1 * | 4/2004 | Regnier et al. | ..... | 49/352 |
| 2004/0134130 | A1 * | 7/2004 | Dobson et al. | ..... | 49/352 |
| 2004/0144032 | A1 * | 7/2004 | Smith | ..... | 49/352 |
| 2004/0154227 | A1 | 8/2004 | Yoshimura | | |
| 2006/0130407 | A1 * | 6/2006 | Castellon | ..... | 49/375 |
| 2007/0000178 | A1 * | 1/2007 | Wild et al. | ..... | 49/352 |
| 2007/0151159 | A1 * | 7/2007 | Arimoto | ..... | 49/352 |
| 2007/0180773 | A1 * | 8/2007 | Fortin et al. | ..... | 49/352 |

* cited by examiner

*Primary Examiner* — Katherine w Mitchell
*Assistant Examiner* — Justin Rephann
(74) *Attorney, Agent, or Firm* — Brinks Hofer Gilson & Lione

(57) ABSTRACT

A window regulator assembly is described that comprises a window bracket that is in contact with the bottom edge of the window; a cable; a carrier plate that is in contact with the window bracket and both ends of the cable; a tension spring located on each end of the cable; an upper bracket assembly; a drum housing having a cable drum; a hollow conduit located between the upper bracket assembly and the drum housing; and a drive unit. The upper bracket assembly, cable drum, and conduit are capable of slideably receiving the cable, while the tension springs provide a predetermined amount of tension to the cable in order for the window regulator assembly to move the window between open and closed positions. Many of the components of the window regulator assembly may be formed from a thermoplastic material.

34 Claims, 8 Drawing Sheets

BOTTOM DRIVE RAIL-LESS WINDOW REGULATOR

FIELD OF THE INVENTION

This disclosure relates to a component for automobiles and particularly to a window regulator assembly used to open and close a window in a side door.

BACKGROUND OF THE INVENTION

Motor vehicles generally feature side door windows which can be moved between lower (opened) and upper (closed) positions. The mechanism used to move the window between these upper and the lower positions is generally known as a window regulator. A window regulator can either be manually operated by a person or driven by a powered actuator, most commonly an electric motor. One type of window regulator utilizes a pulley system. This pulley system uses a metal cable wrapped around a drum coupled to an electric motor or hand crank to drive a carrier that is fastened to the window and engages a guide rail to control motion as the carrier moves vertically.

Conventional cable and drum type window regulator assemblies may be categorized into either dual rail or single rail configurations. In a dual rail configuration, a pair of separated rails is provided in which each rail includes a clamp fastened to the lower edge of the window. These clamps are then moved in a synchronized manner to raise and lower the window. In a single rail configuration, a single rail is positioned near the center of the window with a clamp fastened at the lower edge of the window. The clamp is then moved vertically along the rail between the open and closed positions. A single rail configuration provides a window regulator assembly with fewer parts than a dual rail configuration. However, the single rail configuration poses a design challenge in providing sufficient stability to control the window's motion. In both the single rail and dual rail configurations, the front and rear edges of the window are retained by and move within a corresponding front and rear window run channel.

Design engineers and manufacturers of automotive components are continuously striving to reduce their cost, complexity, and weight in order to provide features and functions for motor vehicles at minimum cost. In one type of existing single rail configuration, a window clamp is made from stamped sheet metal. This sheet metal part is formed to span across the guide rail in order to adequately engage the rail and to include enough space to mount a pair of separated clamps that fasten to the lower or bottom edge of the window. This large sheet metal stamping is a relatively heavy and expensive component to fabricate.

Therefore, improved regulator assemblies that are relatively light-weight and inexpensive to manufacture are continuously desired. It is also desirable to reduce the complexity of the regulator assembly, thereby, simplifying both the manufacturing and operation of the assembly.

SUMMARY OF THE INVENTION

One form of the present disclosure is to provide an improved regulator assembly that can be substantially formed from injection molded plastic resins and to which other components may be added in a manner that provides a cost effective and functional assembly.

The present invention generally provides a window regulator assembly for moving a window between opened and closed positions in a vehicle door. The vehicle door is typically comprised of at least one door panel and front and a rear window run channels in which the window edges may reversibly move. One embodiment of a window regulator assembly constructed in accordance with the teachings of the present invention comprises a window bracket; a cable; a carrier plate; a tension spring; an upper bracket assembly; a drum housing including a cable drum; and a drive unit. A hollow conduit is located between the upper bracket assembly and the drum housing. The upper bracket assembly, cable drum, and conduit are capable of slideably receiving the cable, while the tension springs provide a predetermined amount of tension to the cable in order for the window regulator assembly to move the window between open and closed positions.

In one aspect of the present invention, the carrier plate further comprises a self-guiding pocket and a tension clip that has a first side and a second side. The tension clip compresses the tension springs located on each end of the cable when the carrier plate and window bracket are separated. The upper surface of the first side of the tension clip is inclined at an angle ($\alpha$) where the angle preferably is greater than about 30 degrees. Contact between the window bracket and the inclined surface of the first side of the tension clip of the carrier plate results in the movement of the tension clip perpendicular to the movement of the window bracket. It is this movement of the tension clip that releases the compression placed on the tension springs, thereby, allowing the tension springs to expand and to provide a predetermined amount of tension to the cable.

In another aspect of the present invention, the window bracket further comprises at least one snap fit clip that interacts with the carrier plate to hold the window bracket and carrier plate together when fully assembled.

In another aspect of the present invention, the upper bracket assembly and the drum housing may further comprise angled projections used to couple with the hollow conduit. In yet another aspect of the present invention, the hollow conduit may be reversibly coupled to the carrier plate through the use of snap fittings.

It is another objective of the present invention to provide a side door having a window moveable between opened and closed positions and at least one door panel. The side door comprises a window having a front edge, a rear edge, a top edge, and a bottom edge; a front window run channel attached to a door panel in which the front window edge may reversibly move; a rear window run channel attached to a door panel in which the rear window edge may reversibly move; and the window regulator assembly as described above. The interaction between the window regulator assembly, the window run channels, and window moves the window between open and closed positions.

The present disclosure provides a means through which the weight and cost of the window regulator assembly may be reduced. Various components of the window regulator system, such as the upper bracket assembly, cable drum, carrier plate, cable drum housing, and window bracket, as well as any gears in the drive unit may be formed from a thermoplastic material. The thermoplastic material may be formed into the component through injection molding, thermoforming, extrusion, or any other means known to one skilled-in-the-art. When desirable these same components may be formed from metal and welded or attached within the door.

Further areas of applicability will become apparent from the description and examples provided herein. It should be understood that the description and any specific examples are intended for purposes of illustration only and are not intended to limit the scope of the present disclosure.

BRIEF DESCRIPTION OF THE DRAWINGS

The drawings described herein are for illustration purposes only and are not intended to limit the scope of the present disclosure in any way.

DETAILED DESCRIPTION

Figure 1:
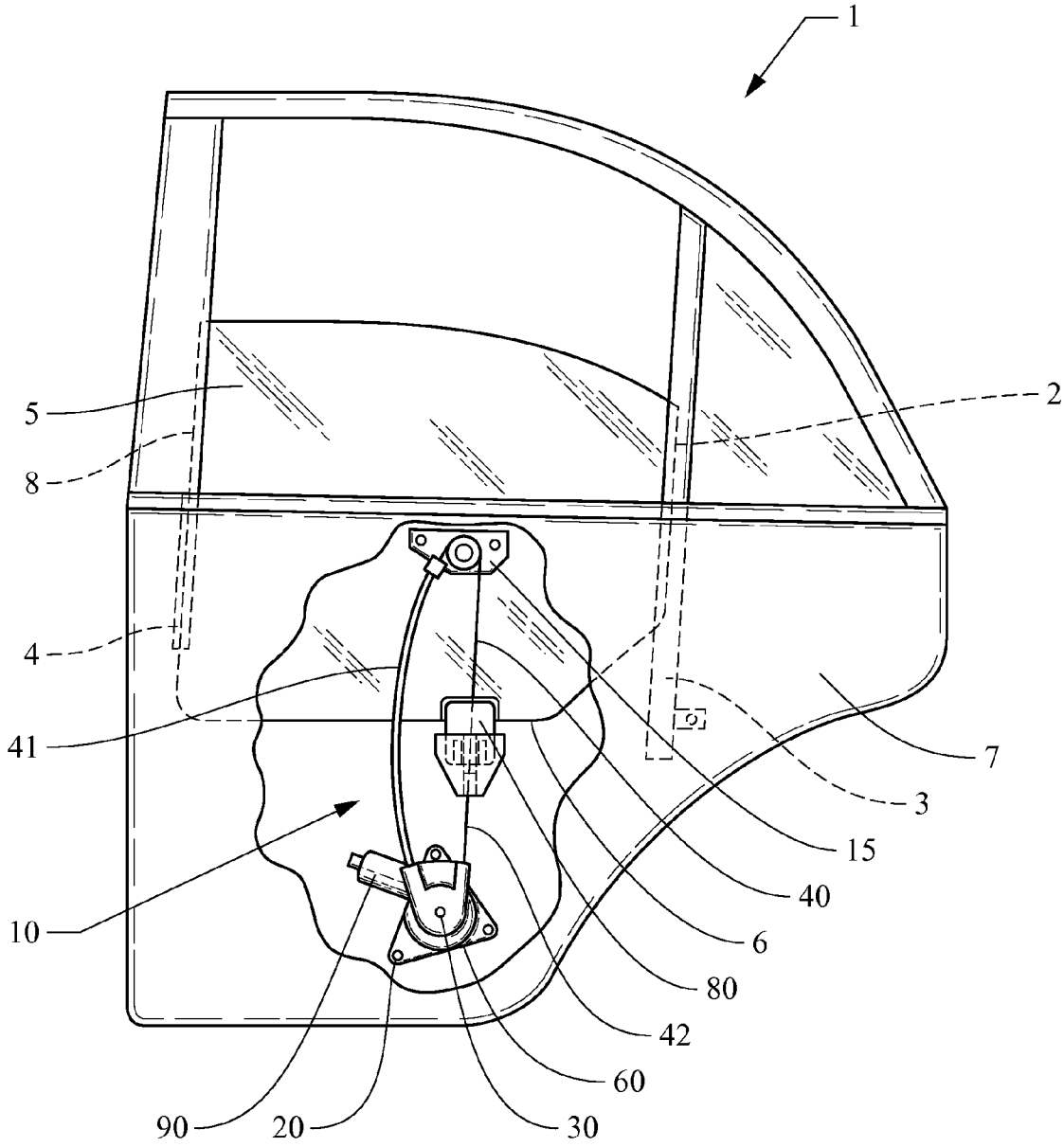
FIG. 1 is a side cut-away view of the interior of a motor vehicle door showing a movable door window and a window regulator assembly including features in accordance with this disclosure.

The following description is merely exemplary in nature and is in no way intended to limit the present disclosure or its application or uses. It should be understood that throughout the description and drawings, corresponding reference numerals indicate like or corresponding parts and features.

The present invention generally provides a window regulator assembly for moving a window having a front, rear, top, and bottom edge between opened and closed positions in a vehicle door. The vehicle door is typically comprised of at least one door panel, a front window run channel in which the front window edge may reversibly move, and a rear window run channel in which the rear window edge may reversibly move. According to one embodiment of the present invention, the window regulator assembly comprises a window bracket that is in contact with the bottom edge of the window; a cable; a carrier plate that is in contact with the window bracket and both ends of the cable; a tension spring located on each end of the cable; an upper bracket assembly; a drum housing having a cable drum; a conduit located between the upper bracket assembly and the drum housing; and a drive unit. The upper bracket assembly, cable drum, and conduit are capable of slideably receiving the cable, while the tension springs provide a predetermined amount of tension to the cable in order for the window regulator assembly to move the window between open and closed positions.

Referring to FIG. 1, a side cut-away view of an automotive door 1 is shown revealing a side movable window 5 and a window regulator assembly 10 positioned within the confines of the inner and outer door panels 7. The front 8 and rear 2 edge of window 5 slideably moves within front 4 and rear 3 run channels. The bottom edge 6 of the window 5 is secured to the window bracket 80 of the window regulator assembly 10. Additional elements of the window regulator assembly 10 that are necessary to make it fully functional are more adequately represented in FIGS. 2A-2E. FIG. 1 illustrates the door window 5 in a position that is approximately half-way between being open or closed. The vertical motion of the window is guided by the front 4 and rear 3run channels that interact with the rear edge 2 and front edge 8 of the window 5. In the fully raised or closed position, the window 5 may be sealed within the frame of the door 1. The run channels 3 and 4 may include a weather strip (not shown) that will interact with the window 5 when the window is in its closed position to provide a weatherable seal.

The window 5 may be formed from glass, a thermoplastic resin, or any other substantially transparent glazing material known to someone skilled-in-the-art. Examples of thermoplastic resins suitable for use as a window 5 include, but are not limited to, polycarbonate, acrylic resins, polyarylate resins, polyester resins, and polysulfone resins.

The front 4 and rear 3 run channels are used as a guide for the movement of the window 5 between open and closed positions, thereby, eliminating the need for a separate guide rail as found in a conventional window regulator assembly. The outer and inner door panels 7 are formed in a manner that establishes a surface upon which the front 4 and rear 3 run channels may be attached if desired.

The front 4 and rear 3 run channels are preferably formed from a thermoplastic material in order to reduce weight and to simplify integration with and provide support for other components in the window regulator assembly. Examples of thermoplastic materials suitable for use as a run channel include, but are not limited to, polyamides, polyalkyene terephthalates, polycarbonates, polyurethanes, acrylonitrile butadiene styrene (ABS), polyesters, nylon, polyoxymethylene (POM), nylon, polypropylene, and mixtures or blends thereof. For strength and reinforcement the thermoplastic materials may incorporate fillers, such as but not limited to long glass fibers (LGF), glass particles, carbon black, and silica. One skilled-in-the-art will recognize that other materials including conventional metal may be used to form the run channels. The run channels may be attached, fastened, or welded to a door panel 7.

Figure 2A:
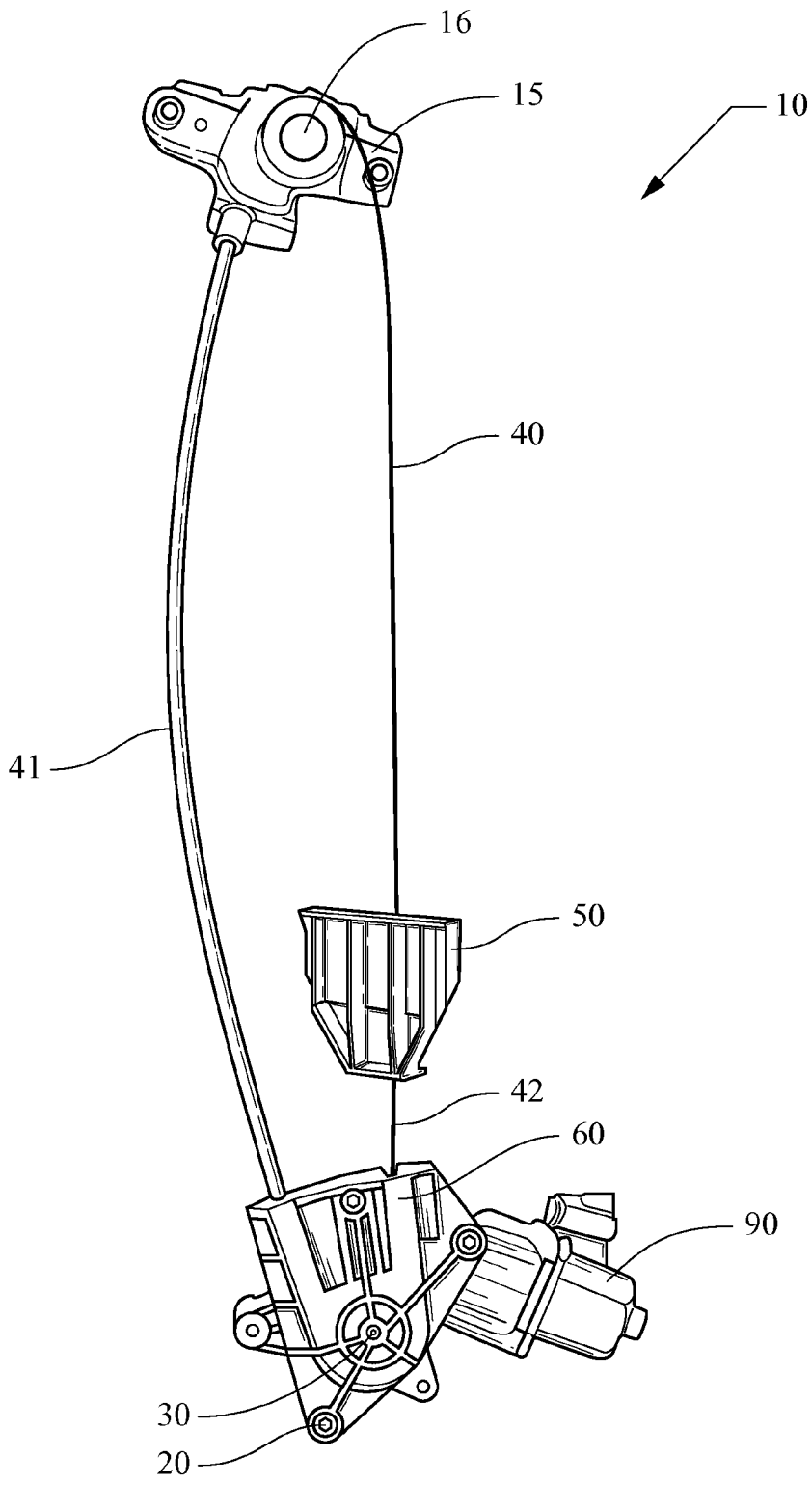
FIG. 2A is a perspective view of the components of a window regulator assembly in accordance with the teachings of this disclosure.
Figure 2B:
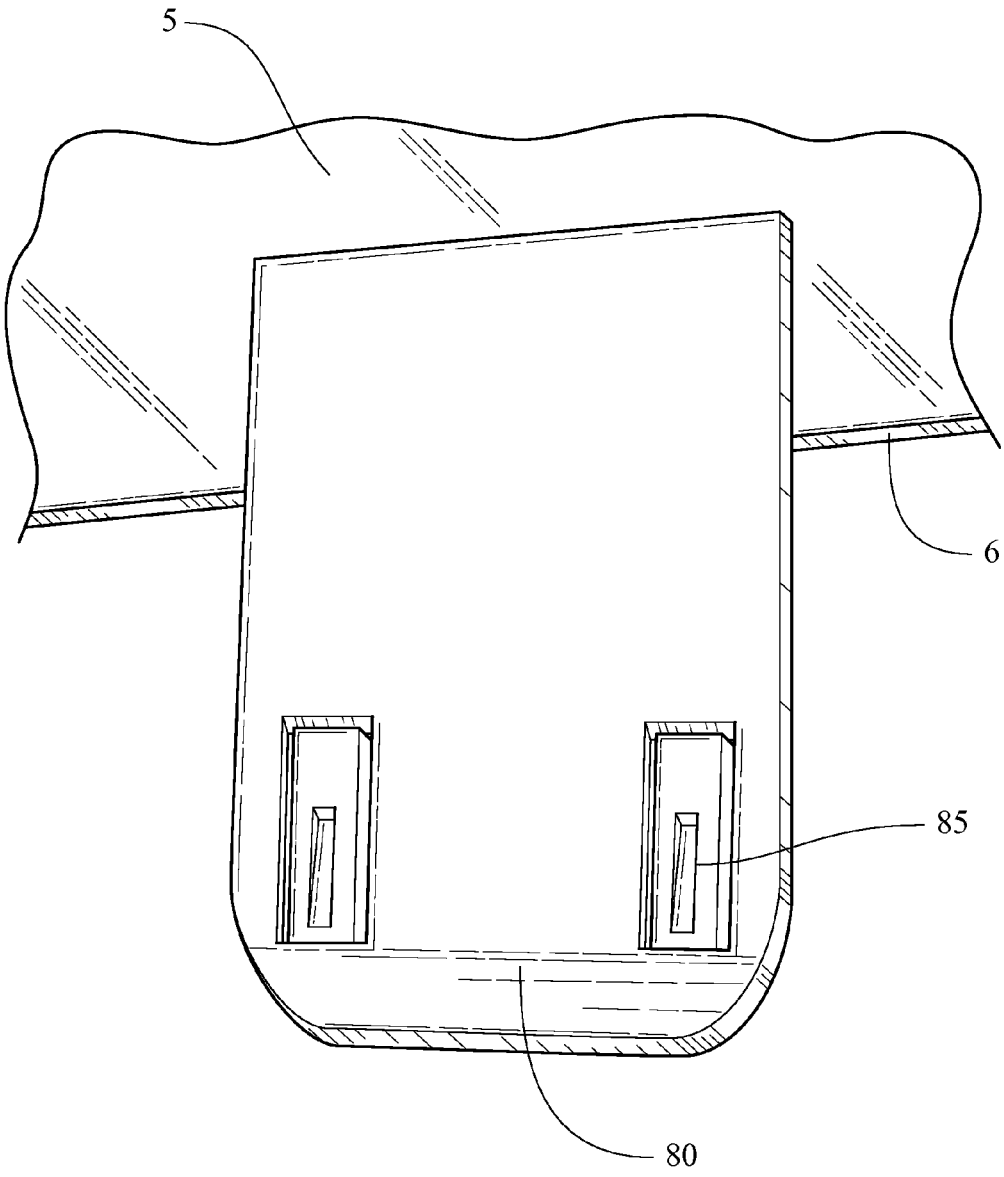
FIG. 2B is a perspective view of a window bracket of the window regulator assembly of FIG. 2A.

Now with reference to FIGS. 2A and 2B, greater details related to various components of the window regulator assembly 10, such as the upper bracket assembly 15, tapping screws 20, cable drum 30, cable 40, carrier plate 50, drum housing 60, tension clip 70, window bracket 80, and drive unit 90 are shown. The carrier plate 50 shown in FIG. 2A makes contact with and may be fastened using snap fit clips 85 formed with or connected to the window bracket 80 shown in FIG. 2B or through any other means of fastening known to one skilled-in-the-art. The window bracket 80 makes contact with the bottom edge 6 of the window 5. The window 5 may be formed with the window bracket 80 or fastened to the window bracket 80 using any means known to one skilled-in-the-art, including but not limited to adhesive bonding. The window bracket 80 may be positioned in any location along the bottom edge 6 of the window 5. However, a location proximate to the center of the bottom edge 6 is preferable.

Figure 2C:
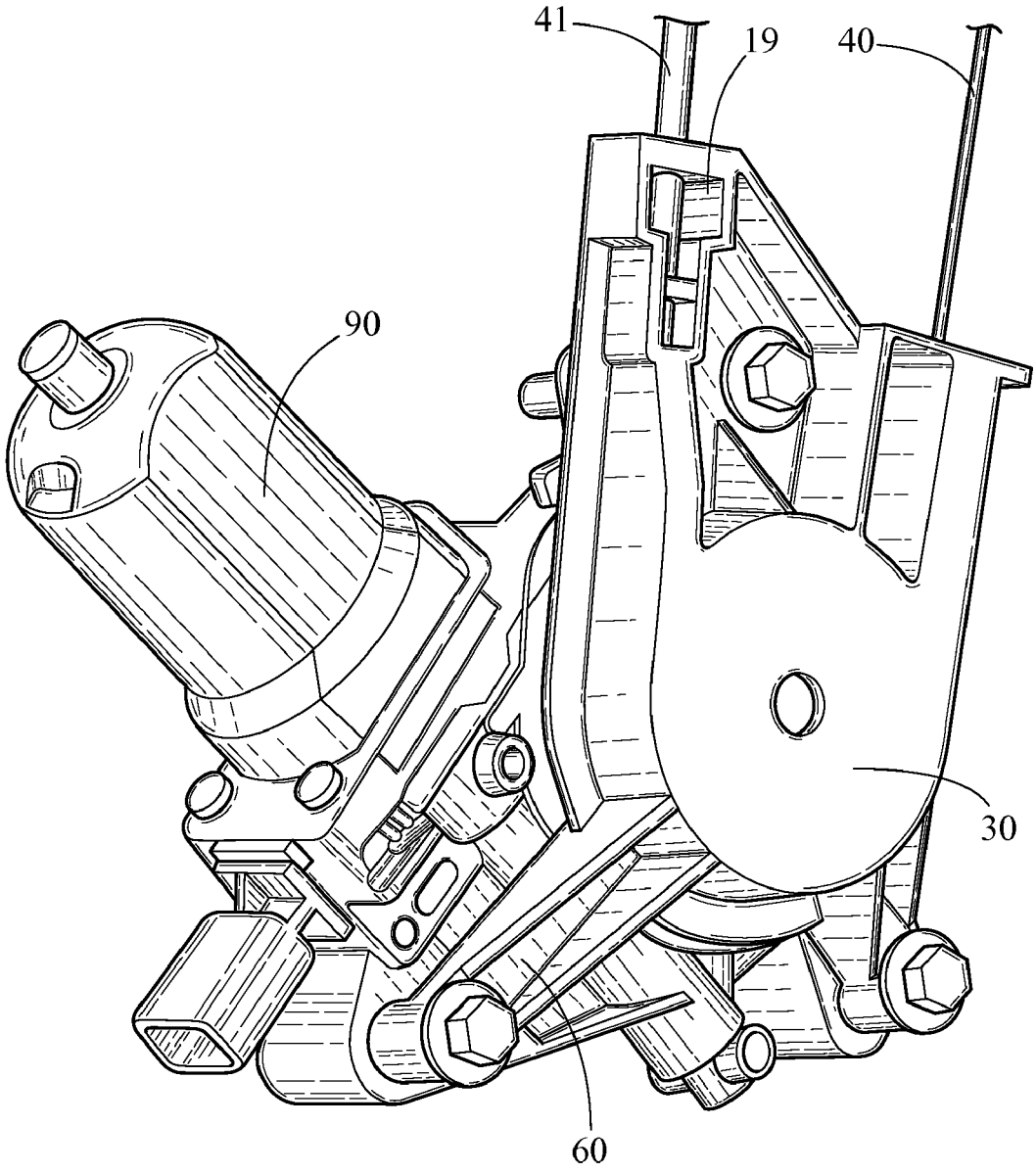
FIG. 2C is a perspective view of another embodiment for the drum housing and drive unit of the window regulator assembly of FIG. 2A.

Each carrier plate 50 is attached or connected to a first end of cables 40 and 42. Such attachment or connection may be made through the use of clamps, fasteners, adhesives, press fittings, snap fittings, or any other means known to one skilled-in-the-art. The cables 40 & 42 may include a nipple on a first end that may be attached, clamped, or fastened to the carrier plate 50. One example of a carrier plate is shown as part of the window clamp assembly described in U.S. patent application Ser. No. 11/784,595 filed on Apr. 9, 2007, which is hereby incorporated by reference in its entirety. As shown in FIG. 2A and 2C, the window regulator assembly 10 also includes a drive unit or motor 90 and a drum housing 60. The second end of cable 40 and first end of cable 42 are coupled to the cable drum 30 located within the drum housing 60. Together, cables 40 and 42 make up a cable assembly where the first end of cable 40 and the second end of cable 42 are coupled to the carrier plate 50. The drive unit 90 causes the cable drum 30 to rotate either clockwise or counterclockwise to move the window between its closed and open positions. The window 5 is caused to move by cable 40 becoming either wound around or unwound from cable drum 30 as it is rotated. The drive unit 90 may be manually operated via a hand crank mechanism or powered, most commonly done using an electric motor attached to a set of gears, such as worm and spur gears. In other words, the drive unit 90 interacts with the cable 40 and the cable drum 30 to provide the cable tension necessary to cause the carrier plate 50 and the window 5 to move between its open and closed positions. The drive unit 90 may be supported by attachment to the door panel 7.

Continuing with FIG. 2A, the upper bracket assembly 15 and the cable drum 30 in the drum housing 60 interact with and are used to guide the movement of the cable 40. Since the upper bracket assembly 15 and cable drum 30 may be exposed to a high force loading when the cable 40 is under tension, the upper bracket assembly 15 and cable drum 30 may be attached to the door panel 7. Thus the load force arising from the tension applied to cable 40 is borne by the door panel 7. The tapping screw 20 is used to secure the drum housing 60 to the door panel 7. The upper bracket assembly 15 may comprise a moveable drum 16 (FIG. 2A) or a stationary semi-circular cable guide 17 (FIG. 2D) around which the cable 40 may slide.

Figure 2D:
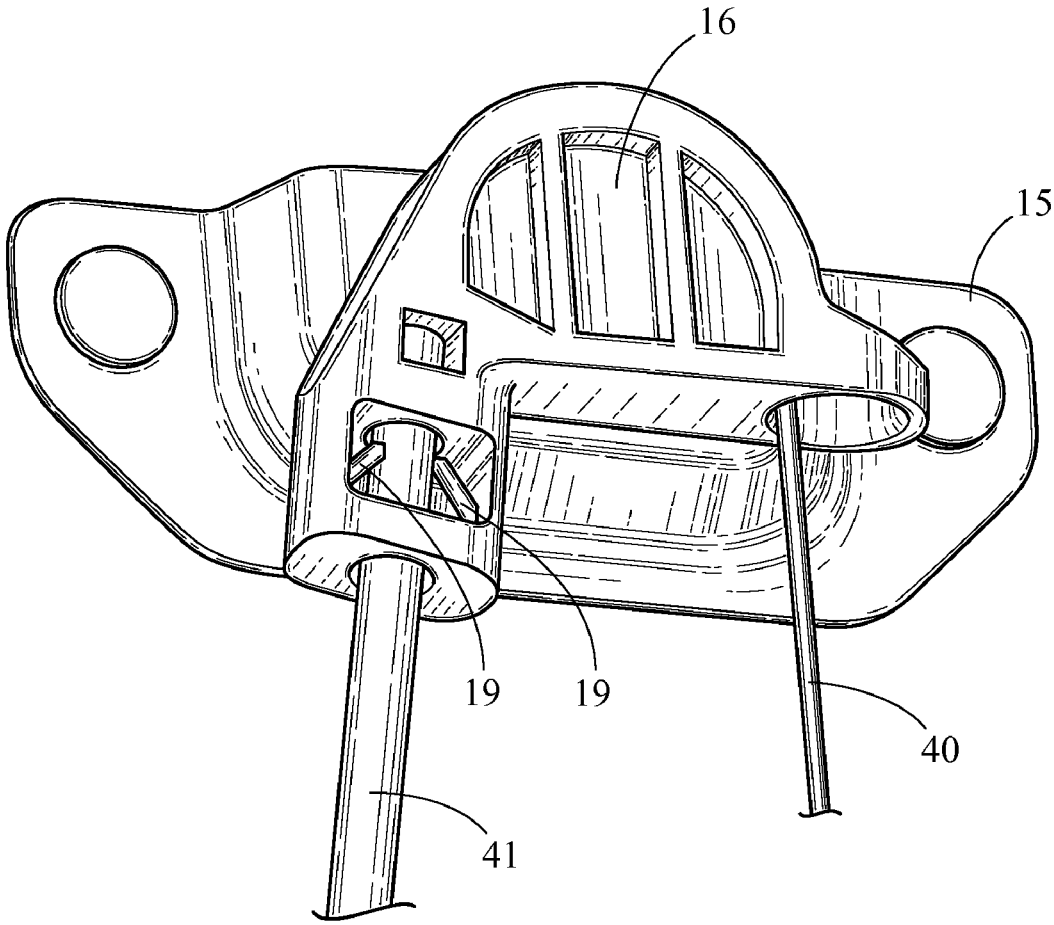
FIG. 2D is a perspective view of another embodiment for the upper bracket assembly of the window regulator assembly of FIG. 2A.
Figure 2E:
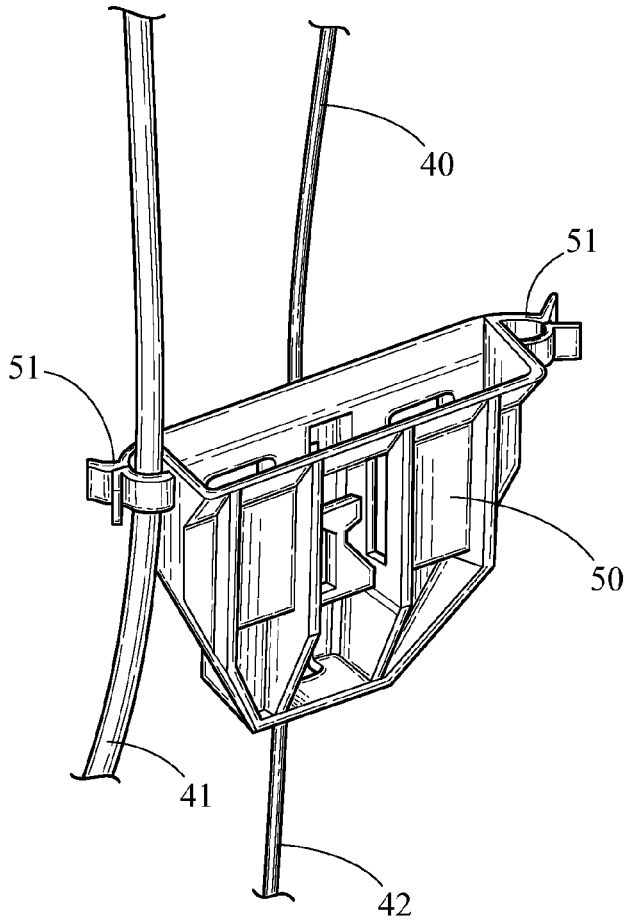
FIG. 2E is a perspective view of another embodiment for the carrier plate of the window regulator assembly of FIG. 2A.

In order to further reduce the amount of force to which the window regulator assembly 10 subjects the door panel 7, it may be desirable in certain instances to route the cable 40 through a fixed, hollow conduit 41. Preferably a conduit 41 is used in conjunction with the cable 40, the upper bracket assembly 15 and the drum housing 60 in the window regulator assembly 10 as shown in FIG. 2A. In this case, the load force arising from the tension applied to cable 40 is borne between the cable drum 30 and upper bracket assembly 15 by the compression force placed on the conduit 41, rather than the door panel 7. Such a conduit 41 may also be used to alter the routing of the cable 40 when there is an obstruction from another component in the door 1. The conduit 41 may also be reversibly coupled to a friction clamp or snap fitting 51 fastened to the side of the carrier plate 50 as shown in FIG. 2E. The coupling of conduit 41 to the snap fitting 51 may be used to hold the conduit 41 during shipping or installation of the regulator assembly 10.

Figure 2F:
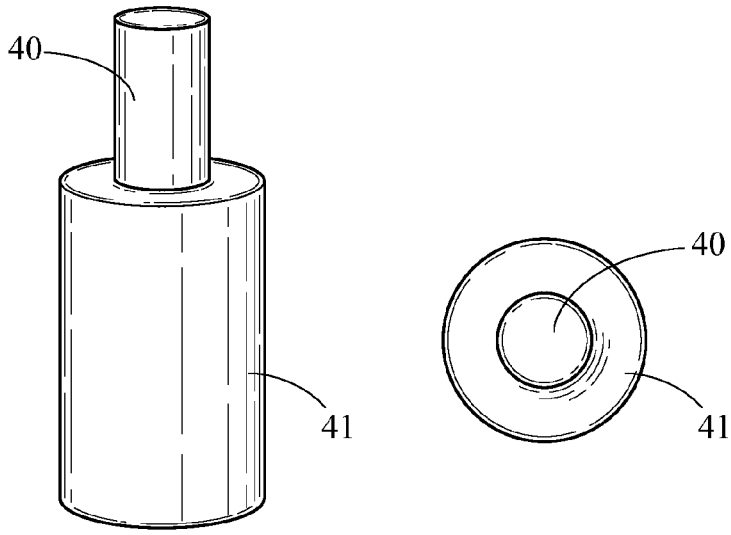
FIG. 2F is a perspective and end-on view of the cable and conduit of the window assembly of FIG. 2A.

Referring now to FIG. 2F, the conduit 41 is hollow and may be made from any flexible non-metallic or metallic sheath known to one skilled-in-the-art. The sheath may be further reinforced with a wound plastic spiral spring, metal wire, or any other type of reinforcement. The conduit 41 may be received by and coupled to the upper bracket assembly 15 (FIG. 2D) and the drum housing 60 (FIG. 2C) using any clamps, fasteners, adhesives, press fittings, snap fittings, or other means known to one skilled-in-the-art. One example of such a fastening means is shown in FIGS. 2D and 2E, which involves the use of at least one angled projection 19 incorporated into the upper bracket assembly 15 or drum housing 60 by molding or any other known method. These angled projections 19 may contact and become imbedded into the outer surface of the sheath of the conduit 41. Preferably the angled projections 19 are configured to allow the hollow conduit 41 to easily slide between the projections 19 in one direction and to provide resistance against movement of the conduit 41 in the opposite or second direction.

The overall cable assembly may be described as comprising a first side and second side located between the upper bracket assembly 15 and the drum housing 60. The first side of the cable assembly includes cable 40 on the first side slideably received by the hollow conduit 41 between the upper bracket assembly 15 and drum housing 60. The second side of the cable assembly includes cable 40 as it slideably exits the upper bracket assembly 15 and is coupled to the carrier plate 50, as well as cable 42 arising from the drum housing and also being coupled to the carrier plate 50.

A window regulator assembly 10 without a conduit 41 being present between the upper bracket assembly 15 and drum housing 60 was observed to result in both deformation of the door panel 7 and consequently a loss of tension on the cable 40. These issues are believed to be directly related to the substantial force exerted by the cable 40 upon the upper bracket assembly 15 and drive unit 90. The addition of a hollow conduit 41 between the upper bracket assembly 15 and drum housing 60 was found to reduce the substantial force exerted by the cable 40 upon the upper bracket assembly 15 and drive unit 90. Thus the deformation of the door panel 7 can be reduced through the use of a conduit 41. Preferably the door panel 7 to which the upper bracket assembly 15 is fastened, should be stiff enough to resist deformation caused by the operation of the window regulator assembly 10. If desirable belt reinforcement of the door panel 7 is possible.

Figure 3A:
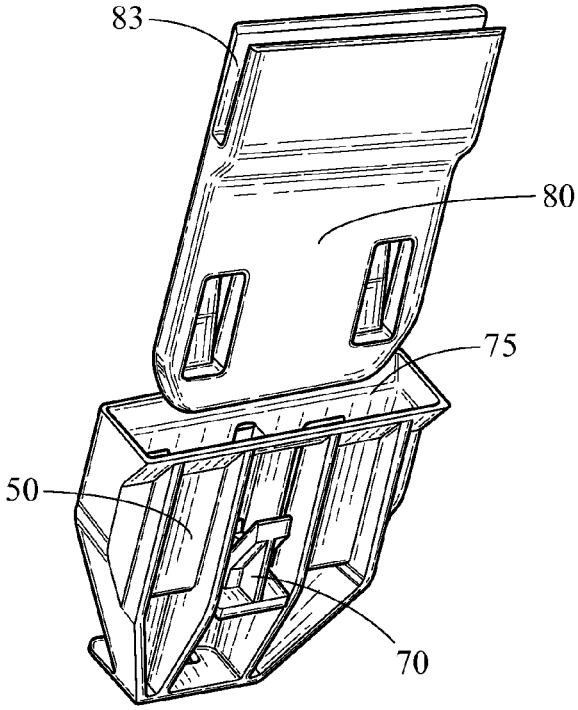
FIG. 3A is a perspective view of the one side of the window bracket and carrier plate of the window regulator assembly in accordance with this disclosure.
Figure 3B:
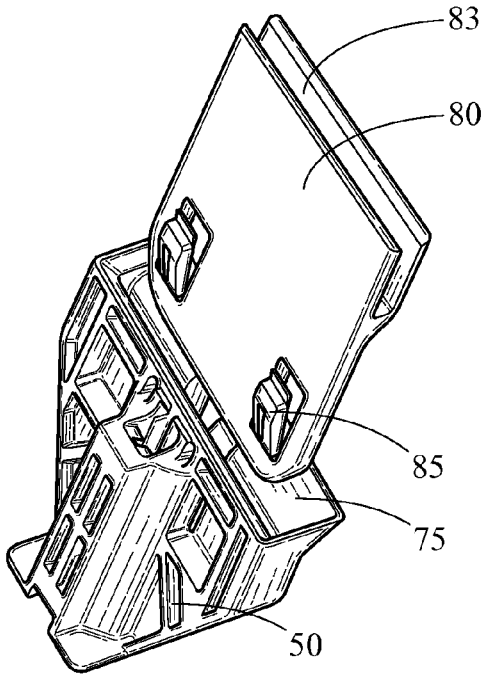
FIG. 3B is a perspective view of the other side of the window bracket and carrier plate of the window regulator assembly in accordance with this disclosure.

Referring now to FIGS. 3A and 3B, the subcomponents of the carrier plate 50 and window bracket 80 are shown in greater detail. The body of the window bracket 80 includes both a window channel 83 and at least one snap fit clip 85. Preferably more than one clip 85 is utilized. In FIG. 3B a window bracket 80 having two snap fit clips 85 integrally formed therewith is shown. The window channel 83 is used to make contact with the bottom edge 6 of the window 5. The window bracket 80 is inserted into a self-guiding pocket 75 located in the top of the carrier plate 50. The bottom of the window bracket 80 when inserted into the self-guiding pocket 75 interacts with a tension clip 70 located near the center of the carrier plate 50.

Figures 4A, 4B, 4C:
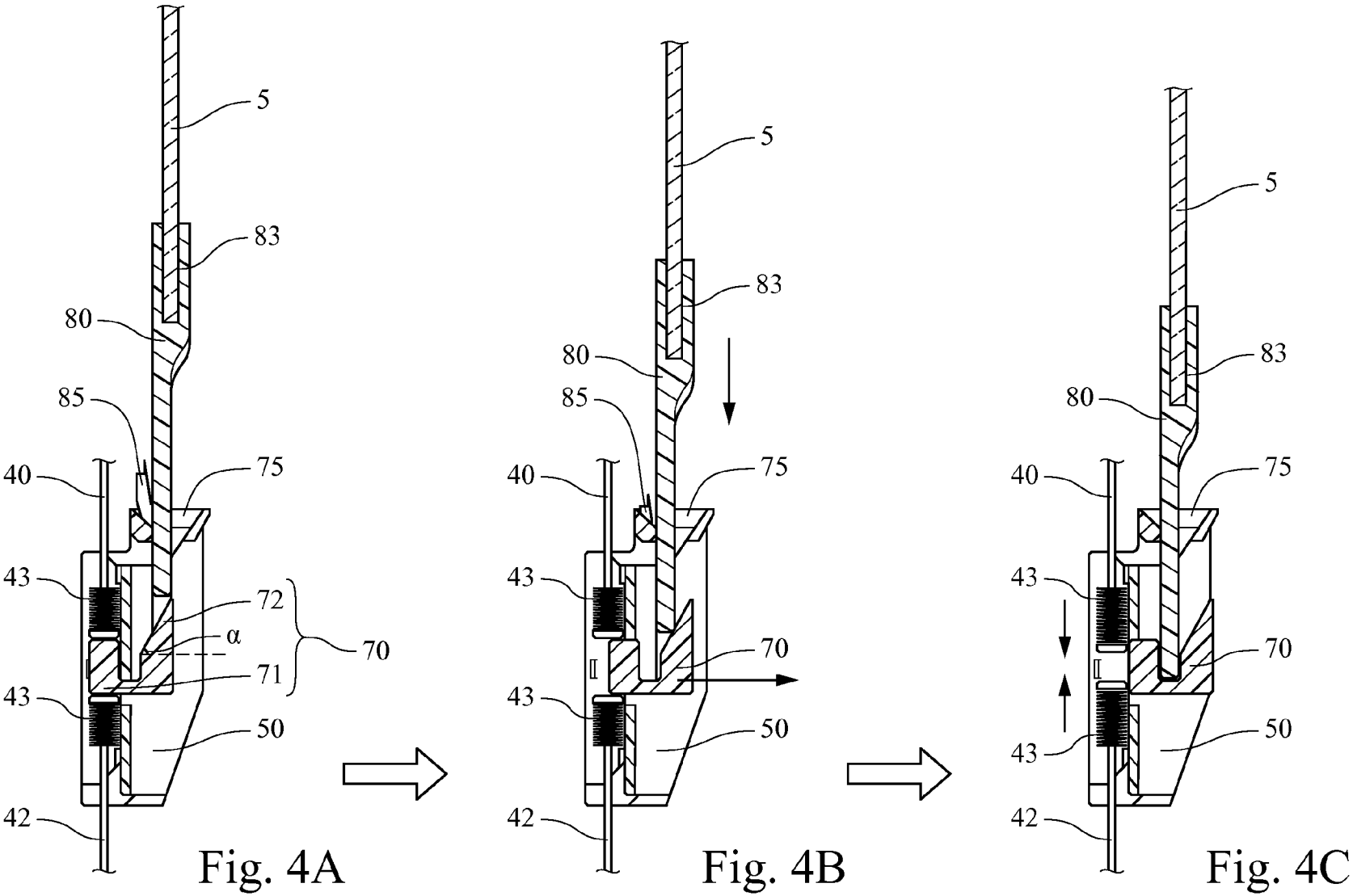
FIG. 4A is a cross-sectional view of the window bracket and carrier of FIG. 3A taken along line A-A when the window bracket and carrier plate are in an initial stage of assembly.
FIG. 4B is a cross-sectional view of the window bracket and carrier of FIG. 3A taken along line A-A when the window bracket and carrier are in an intermediate stage of assembly.
FIG. 4C is a cross-sectional view of the window bracket and carrier of FIG. 3A taken along line A-A when the window bracket and carrier are in a final stage of assembly.

Referring now to FIGS. 4A-4C, the assembly of the carrier plate 50 and window bracket 80 is shown in greater detail. In FIGS. 4A-4C a cross-sectional view taken along line A-A is shown with respect to the carrier plate 50 and window bracket 80 at different stages of assembly. Primarily, the initial stage (FIG. 4A), intermediate stage (FIG. 4B), and final stage (FIG. 4C) of assembly are depicted. The assembly of the window bracket 80 and carrier plate 50 provides a mechanism that automatically establishes the desired or predetermined cable tension as explained in the following paragraphs.

In the initial stage of assembly the cable 40 is loose with no tension being applied. This allows for easier installation of the drive unit 90 and the upper bracket assembly 15 than is the case for a conventional window regulator assembly where various components are under tension during assembly. As shown in FIG. 4A, the window bracket 80 is then inserted into the self-guiding pocket 75 located in the top of the carrier plate 70. As the window bracket 80 is pushed into the self-guiding pocket 75, the bottom of the bracket 80 contacts the upper surface of the first side 72 of the tension clip 70. This upper surface is inclined at an angle ($\alpha$) as shown in FIG. 4A. Although the angle ($\alpha$) may be any desired angle, preferably this angle is greater than about 30 degrees, with an angle of about 60 degrees or greater being more preferable.

The second side 71 of the tension clip 70 is used in this initial stage of assembly to compress and separate tension springs 43 fixed to the ends of the cable 40. In this configuration, the total tension on the cable 40 is small or in other words, the cable 40 as positioned in the window regulator assembly 10 is loose. In this intermediate stage of assembly (FIG. 4B), the window bracket 80 is further inserted into the self-guiding pocket 75. The frictional contact between the window bracket 80 and the inclined surface on the first side 72 of the tension clip 70 causes the tension clip 70 to move perpendicular to the movement of the window bracket 80.

In the final stage of assembly (FIG. 4C), the window bracket 80 reaches the end of the inclined surface of the tension clip 70 and comes to rest in a stopped position. In this stage of assembly, the tension clip 70 has moved to such a degree that the tension springs 43 are no longer constricted by the presence of the second side 71 of the tension clip 70. Thus the springs 43 are released and the desired, predetermined level of tension is placed on the cable 40 of the window regulator assembly 10.

It is another objective of the present invention to provide a side door having a window moveable between opened and closed positions and at least one door panel. The side door comprises a window having a front edge, a rear edge, a top edge, and a bottom edge; a front window run channel attached to a door panel in which the front window edge may reversibly move; a rear window run channel attached to a door panel in which the rear window edge may reversibly move; and a window regulator assembly as previously described. The interaction between the window regulator assembly, the window run channels, and window moves the window between open and closed positions.

The window run channels 3 and 4, carrier plate 50, window bracket 80, upper bracket assembly 15, drum housing 60, and other components, including but not limited to, the gears in the drive unit 90, may be formed from a thermoplastic material or a metal. Examples of thermoplastic materials suitable for use include, but are not limited to, polyamides, polyalkyene terephthalates, polycarbonates, polyurethanes, acrylonitrile butadiene styrene (ABS), polyesters, nylon, polyoxymethylene (POM), nylon, polypropylene, and mixtures or blends thereof. For strength and reinforcement the thermoplastic materials may incorporate fillers, such as but limited to long glass fibers (LGF), glass particles, carbon black, and silica. One skilled-in-the-art will recognize that other materials may also be used, such as conventional metals.

Thermoplastic materials may be formed into the components described above using any technique known to one skilled-in-the-art. Examples of suitable techniques include, but are not limited to, injection molding, thermoforming, and extrusion. Metals may be formed into the components described above, as well as the window run channels, using any technique known to one skilled-in-the-art, including but not limited to, roll forming, forging, extrusion & drawing, sheet metal forming, and powder metallurgy.

The foregoing description of various embodiments of the invention has been presented for purposes of illustration and description. It is not intended to be exhaustive or to limit the invention to the precise embodiments disclosed. Numerous modifications or variations are possible in light of the above teachings. The embodiments discussed were chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally, and equitably entitled.

What is claimed is:

1. A window regulator assembly for moving a window having a front, rear, top, and bottom edge between opened and closed positions in a vehicle door having an inner and outer door panel, a front window run channel in which the front window edge may reversibly move, and a rear window run channel in which the rear window edge may reversibly move, the window regulator assembly comprising:

a window bracket in contact with the bottom edge of the window;

a cable assembly having first and second ends;

a carrier plate coupled with the window bracket and both ends of the cable assembly; the carrier plate comprising a self-guiding pocket and a tension clip having a first side and a second side; the upper surface of the first side of the tension clip being inclined at an angle ($\alpha$);

a tension spring located on at least one end of the cable assembly to provide a predetermined amount of tension to the cable assembly, thereby, generating a load force;

an upper bracket assembly capable of slideably receiving the cable assembly;

a drum housing having a cable drum capable of slideably receiving the cable assembly;

a hollow conduit located between the upper bracket assembly and the drum housing that can slideably receive the cable assembly; and a drive unit for rotating the cable drum clockwise or counterclockwise;

wherein the load force generated upon applying tension to the cable assembly is borne between the cable drum and the upper bracket assembly by a compression force placed upon the conduit;

wherein attaching the window bracket and carrier plate allows the tension spring to tension the cable assembly;

wherein contact between the window bracket and the inclined surface of the first side of the tension clip of the carrier plate results in the movement of the tension clip perpendicular to the movement of the window bracket;

wherein the window regulator assembly interacts with the window run channels to move the window between the open and the closed positions.

2. The window regulator assembly of claim 1, wherein the angle ($\alpha$) is greater than 30 degrees.

3. The window regulator assembly of claim 2, wherein the angle ($\alpha$) is greater than 60 degrees.

4. The window regulator assembly of claim 1, wherein the movement of the tension clip releases the compression placed on the tension spring, thereby, allowing the tension spring to expand and to provide a predetermined amount of tension to the cable assembly.

5. The window regulator assembly of claim 4, wherein the window bracket further comprises at least one snap fit clip that interacts with the carrier plate to hold the window bracket and carrier plate together.

6. The window regulator assembly of claim 1, wherein the carrier plate further comprises a snap fitting to which the hollow conduit may be coupled.

7. The window regulator assembly of claim 1, wherein the drive unit is attached to the door panel.

8. The window regulator assembly of claim 1, wherein the cable contacts the carrier plate using a means selected as one from the group of clamps, fasteners, adhesives, press fittings, and snap fittings.

9. The window regulator assembly of claim 1, wherein the upper bracket assembly or the drum housing further comprise at least one angled projection in contact with the hollow conduit to provide resistance against further movement of the hollow conduit.

10. The window regulator assembly of claim 1, wherein the upper bracket assembly further comprises one selected from the group of a moveable drum and a stationary semi-circular cable guide around which the cable assembly may slide.

11. The window regulator assembly of claim 1 wherein one or more of the carrier plate, window bracket, upper bracket assembly, drum housing, and cable drum are formed from a thermoplastic material or a metal.

12. The window regulator assembly of claims 11, wherein the thermoplastic material is formed into one or more of the window bracket, carrier plate, upper bracket assembly, drum housing, and cable drum using an injection molding, thermoforming, or extrusion process.

13. The window regulator assembly of claims 11, wherein the metal is formed into one or more of the window bracket, carrier plate, upper bracket assembly, drum housing, and cable drum using roll forming, forging, extrusion, drawing, sheet metal forming, or a powder metallurgy process.

14. The window regulator assembly of claim 1, wherein the window is formed from glass or a thermoplastic material.

15. The window regulator assembly of claim 1, wherein the cable assembly comprises a first side and second side located between the upper bracket assembly and the drum housing;

wherein the first side is slideably received by the hollow conduit and the second side is coupled to the carrier plate.

16. The window regulator assembly of claim 1, wherein the hollow conduit is made from a flexible, non-metallic or metallic material.

17. A side door having a window moveable between opened and closed positions and at least one door panel, the side door comprising:

a window having a front edge, a rear edge, a top edge, and a bottom edge;

a front window run channel attached to a door panel in which the front window edge may reversibly move;

a rear window run channel attached to the door panel in which the rear window edge may reversibly move; and a window regulator assembly comprising:

a window bracket in contact with the bottom edge of the window;

a cable assembly having first and second ends;

a carrier plate in contact with the window bracket and both ends of the cable assembly; the carrier plate comprising a self-guiding pocket and a tension clip having a first side and a second side;

a tension spring located on at least one end of the cable assembly to provide a predetermined amount of tension to the cable assembly, thereby, generating a load force;

an upper bracket assembly capable of slideably receiving the cable assembly;

a drum housing having a cable drum capable of slideably receiving the cable assembly the cable assembly;

a hollow conduit located between the upper bracket assembly and the drum housing that can slideably receive the cable assembly; and a drive unit for rotating the cable drum;

wherein the load force generated upon applying tension to the cable assembly is borne between the cable drum and the upper bracket assembly by a compression force placed upon the conduit;

wherein the second side of the tension clip compresses the tension springs located on each end of the cable when the carrier plate and window bracket are separated;

wherein the interaction between the window regulator assembly, the window run channels, and window moves the window between open and closed positions.

18. The side door of claim 17, wherein the upper surface of the first side of the tension clip is inclined at an angle ($\alpha$).

19. The side door of claim 18, wherein the angle ($\alpha$) is greater than about 30 degrees.

20. The side door of claim 18, wherein contact between the window bracket and the inclined surface of the first side of the tension clip of the carrier plate results in the movement of the tension clip perpendicular to the movement of the window bracket.

21. The side door of claim 20, wherein the movement of the tension clip releases the compression placed on the tension spring, thereby, allowing the tension spring to expand and to provide the predetermined amount of tension to the cable assembly.

22. The side door of claim 21, wherein the window bracket further comprises at least one snap fit clip that interacts with the carrier plate to hold the window bracket and carrier plate together.

23. The side door of claim 17 wherein one or more of the window run channels, carrier plate, window bracket, upper bracket assembly, drum housing, and cable drum are formed from a thermoplastic material or a metal.

24. The side door of claim 17, wherein the window is formed from glass or a thermoplastic material.

25. The side door of claim 17, wherein the carrier plate further comprises a snap fitting to which the hollow conduit may be coupled.

26. The side door of claim 17, wherein the upper bracket assembly or the drum housing further comprise at least one angled projection in contact with the hollow conduit to provide resistance against further movement of the hollow conduit.

27. The side door of claim 17, wherein the upper bracket assembly further comprises one selected from the group of a moveable drum and a stationary semi-circular cable guide around which the cable assembly may slide.

28. The side door of claim 17, wherein the hollow conduit in the window regulator assembly is made from a flexible, non-metallic or metallic material.

29. A rail-less, bottom drive window regulator assembly for moving a window having a front, rear, top, and bottom edge between opened and closed positions in a vehicle door having at least one door panel with front and rear window run channels in which the front and rear window edges may vertically move, the rail-less, bottom drive window regulator assembly comprising:

a window bracket in contact with the bottom edge of the window;

a cable assembly capable of generating a load force when tensioned;

an upper bracket assembly capable of slideably receiving the cable assembly; the upper bracket assembly being attached proximate to the top of the door panel;

a drum housing having a cable drum capable of slideably receiving the cable assembly and a drive unit for rotating the cable drum; the drum housing being attached proximate to the bottom of the door panel and aligned with the upper bracket assembly in order to allow the window to move in a vertical direction; and a curved, hollow conduit attached to the upper bracket assembly and the drum housing capable of slideably receiving the cable assembly;

wherein the load force generated upon applying tension to the cable assembly is borne between the cable drum and the upper bracket assembly by a compression force placed upon the conduit such that the conduit prevents deformation of the door panel;

wherein the drum housing remains below the window when the interaction between the window regulator assembly, the window run channels, and window moves the window between the open and closed positions.

30. The rail-less, bottom drive window regulator assembly of claim 29, wherein the upper bracket assembly or the drum housing further comprise at least one angled projection in contact with the hollow conduit to provide resistance against further movement of the hollow conduit.

31. The rail-less, bottom drive window regulator assembly of claim 29, wherein the hollow conduit is made from a flexible, non-metallic or metallic material.

32. The rail-less, bottom drive window regulator assembly of claim 29, wherein the upper bracket assembly comprises a moveable drum or a stationary semi-circular cable guide around which the cable assembly may slide.

33. The rail-less, bottom drive window regulator assembly of claim 29, wherein the window regulator assembly further includes a carrier plate coupled with the window bracket and the cable assembly; the carrier plate comprising a self-guiding pocket and a tension clip.

34. The rail-less, bottom drive window regulator assembly of claim 33, wherein the window regulator assembly further comprises a tension spring attached to the cable assembly; the tension spring being under compression;

wherein the movement of the tension clip releases the compression placed on the tension spring, thereby, allowing the tension spring to expand and to provide a predetermined amount of tension to the cable assembly.

* * * * *